US005783158A

United States Patent [19]

Tacke et al.

[11] Patent Number: 5,783,158

[45] Date of Patent: Jul. 21, 1998

[54] PROCESS FOR TREATING SULFIDE ORES CONTAINING GOLD AND/OR SILVER AND AS ACCOMPANYING METAL AT LEAST IRON

[75] Inventors: Michael Tacke, Friedrichsdorf; Walter Pierson, Eschborn; Eberhard Stolarski, Oberursel, all of Germany

[73] Assignee: Metallgesellschaft Aktiengesellschaft, Frankfurt am Main, Germany

[21] Appl. No.: 805,462

[22] Filed: Feb. 25, 1997

[30] Foreign Application Priority Data

Mar. 9, 1996 [DE] Germany ..... 196 09 284.1

[51] Int. Cl.[6] ..... C22B 11/00; C22B 11/08; C22B 1/00

[52] U.S. Cl. ..... 423/47; 423/45; 423/27; 423/29; 423/153; 423/150.1

[58] Field of Search ..... 423/47, 23, 27, 423/45, 29, 153, 150.1

[56] References Cited

U.S. PATENT DOCUMENTS

| | | | |
|---|---|---|---|
| 1,582,347 | 4/1926 | Read et al. | 423/47 |
| 1,974,886 | 9/1934 | Young | 423/45 |
| 2,209,331 | 7/1940 | Haglund | 423/47 |
| 2,878,102 | 3/1959 | Sternfels | 423/47 |
| 2,910,348 | 10/1959 | Kuss et al. | 423/45 |
| 3,791,812 | 2/1974 | Frank et al. | 423/27 |
| 4,342,591 | 8/1982 | Lesoille | 423/27 |
| 4,579,589 | 4/1986 | Yuill et al. | 423/45 |
| 4,731,114 | 3/1988 | Ramadorai et al. | 423/45 |
| 5,123,956 | 6/1992 | Fernandez et al. | 423/47 |

*Primary Examiner*—Steven Bos

*Attorney, Agent, or Firm*—Herbert Dubno; Jonathan Myers

[57] ABSTRACT

The ore which contains gold and/or silver and as accompanying metal at least iron is calcined at temperatures in the range from 500° to 900° C. with the addition of oxygen-containing gas. There is obtained a metal-oxide-containing solids mixture and a $SO_2$-containing exhaust gas. The solids mixture from the calcination is cooled, the temperature being reduced by at least 50° C. The cooled solids mixture is added to a fluidized-bed reactor, and $SO_2$-containing exhaust gas is introduced into the fluidized-bed reactor. In the reactor, metal sulfate is produced in the solids mixture, so that at least 10% of the sulfur content are bound in the exhaust gas. Solids mixture containing metal sulfate is withdrawn from the fluidized-bed reactor, is stirred up with an aqueous acid solution, thereby dissolving metal sulfate. The remaining solids are supplied to a recovery of gold and/or silver.

7 Claims, 1 Drawing Sheet

PROCESS FOR TREATING SULFIDE ORES CONTAINING GOLD AND/OR SILVER AND AS ACCOMPANYING METAL AT LEAST IRON

FIELD OF THE INVENTION

This invention relates to a process for treating a granular sulfide ore containing as a noble metal gold, silver or gold and silver and as an accompanying base metal at least iron. The invention further relates to a process for treating the sulfide ore through calcination at temperatures in the range of 500° to 900° C. with the addition of a gas containing free oxygen to produce a metal oxide containing solids mixture and an $SO_2$-containing gas.

BACKGROUND OF THE INVENTION

Processes for treating sulfide ores are described in DE-C-4122895 and DE-C-4329417. All of these processes seek to perform the calcination in an optimized way. The $SO_2$-containing exhaust gas produced is purified and no longer brought in contact with the metal-oxide-containing solids mixture produced during the calcination.

OBJECT OF THE INVENTION

The object of the invention is to at least partially bind the $SO_2$ of the exhaust gas during the treatment of the sulfide ore, and at the same time improve the metal recovery, where an increased yield of gold, silver or gold and silver is achieved.

SUMMARY OF THE INVENTION

The object of the invention is achieved according to the abovementioned process in that the noble metal containing, base metal oxide containing solids mixture from the calcination is cooled, where the temperature is reduced by at least 50° C., that the cooled solids mixture is charged into a fluidized-bed reactor, and $SO_2$-containing gas is introduced into the fluidized-bed reactor, where in the solids mixture base metal sulfate is produced and at least 10% of the sulfur content in the exhaust gas is bound in the form of base metal sulfate. A solids mixture containing base metal sulfate is withdrawn from the fluidized-bed reactor, stirred up with an aqueous acid solution by dissolving base metal sulfate. The solids containing noble metal are separated from the solution, and the solids are supplied to a recovery of gold and/or silver. Preferably, at least 20% of the sulfur content of the exhaust gas is bound in the fluidized-bed reactor in the form of base metal sulfate.

The base metal sulfate, preferably a transition metal sulfate, e.g. iron sulfate, produced in the fluidized-bed reactor in the solids mixture is water-soluble and is removed from the solids mixture in dissolved form. As a result, the pore volume in the remaining solids mixture is increased considerably, and the attacking capacity of the leaching solution (e.g. cyaniding) in the noble metal recovery is improved considerably. Since copper, zinc and nickel as accompanying base metals can also be removed in this way at least in part prior to the recovery of noble metals, this represents a substantial reduction of the cyanide consumption during the recovery of the noble metal. At the same time, the secondary treatment of the exhaust gas for the removal of $SO_2$ is facilitated. Copper, zinc and nickel can be recovered separately from the liquid phase. Where silver is present in the sulfide ore, some of the silver may form the sulfate salt and be recovered together with the base metals such as copper.

In the fluidized-bed reactor, the base metal sulfate is usually produced at temperatures in the range from 100° to 650° C., and preferably 200° to 600° C. The fluidized-bed reactor can have a single-stage or a multi-stage design. The fluidized bed can be a stationary, circulating or even expanded fluidized bed. What is important is an intensive gas-solids contact in the fluidized-bed reactor with sufficient dwell times, so as to achieve the desired conversion of base metal oxides to base metal sulfates. In the fluidized-bed rector, iron oxide is for instance reacted with $SO_2$ and oxygen according to the following equation:

$$2Fe_2O_3+6SO_2+3O_2 \rightarrow 2Fe_2(SO_4)_3$$

Faster than $SO_2$, $SO_3$ reacts with iron oxide according to the following equation:

$$Fe_2O_3+3SO_3 \rightarrow Fe_2(SO_4)_3$$

In the fluidized-bed reactor, $SO_3$ is in part automatically formed from $SO_2$ under the catalytic effect of the existing base metal oxides in the presence of free oxygen, which promotes the formation of sulfate. If it is desired to further accelerate the formation of sulfate, it is recommended to at least partially subject the $SO_2$ in the exhaust gas to a catalytic oxidation before the fluidized-bed reactor, and to introduce an exhaust gas, which is more or less enriched in $SO_3$, into the fluidized-bed reactor.

The reactions taking place in the fluidized-bed reactor are exothermal reactions, and the temperatures there should be prevented from increasing too much. This is on the one hand effected in that the solids mixture coming from the calcination is first of all cooled, where the temperature is reduced by at least 50° C., and preferably by at least 100° C., before the solids mixture is charged into the fluidized-bed reactor. Preferably, the noble metal containing, base metal-oxide-containing solids mixture produced through calcination of the sulfide ore is cooled to temperatures in the range from 100° to 350° C., before it is charged into the fluidized-bed reactor. It is furthermore expedient to dissipate heat in the fluidized-bed reactor through indirect cooling.

BRIEF DESCRIPTION OF THE DRAWING

Embodiments of this process will now be illustrated with reference to the drawing that is FIG. 1.

DETAILED DESCRIPTION OF THE DRAWING

Figure 1:
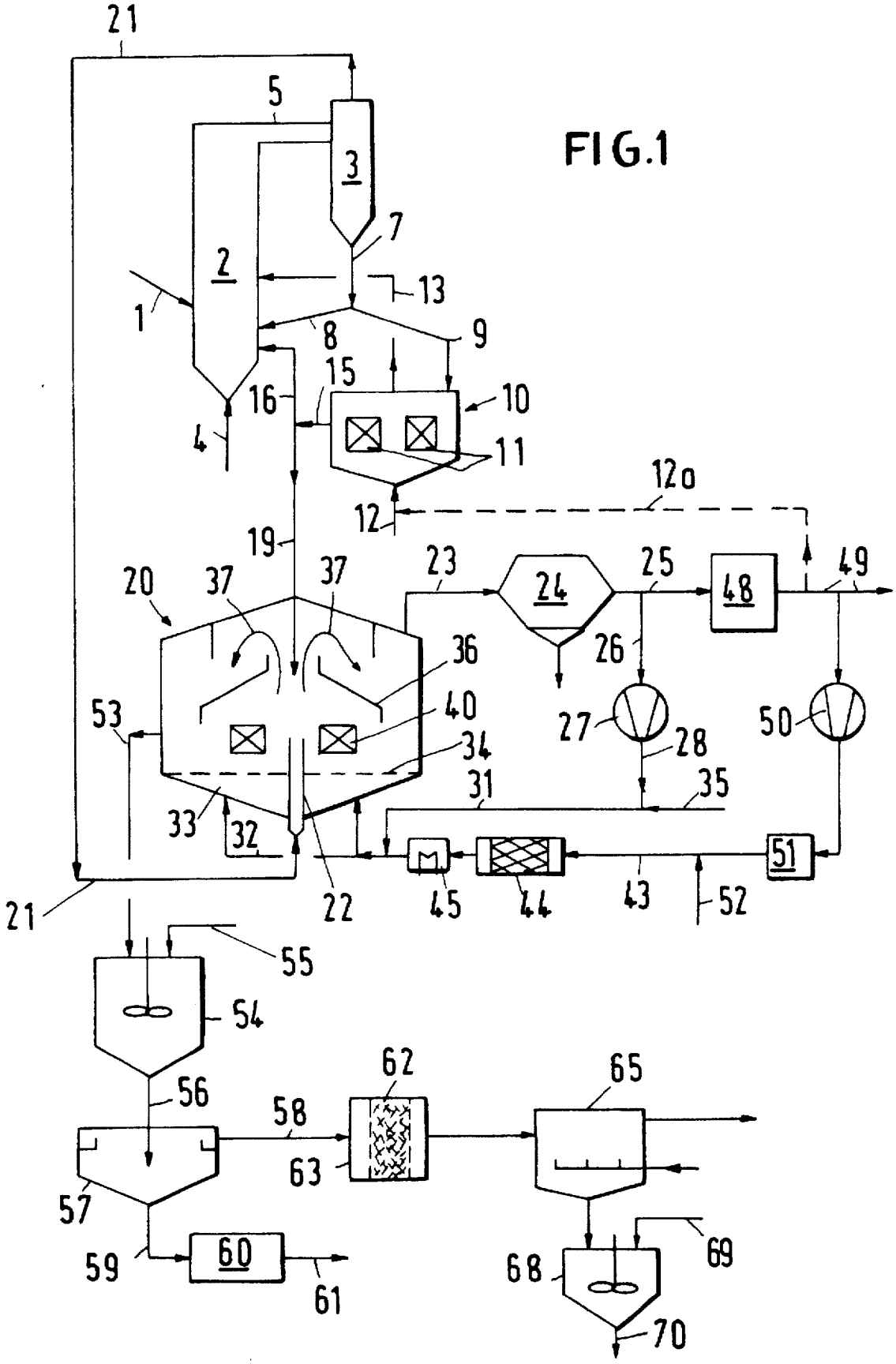
FIG. 1 shows a flow diagram of the process.

For calcining purposes, granular ore is supplied via line 1. The ore, which may also be an ore concentrate, usually has grain sizes in the range from 0.01 to 4 mm. Calcination is effected at temperatures in the range from 500° to 900° C. in the circulating fluidized bed in the calcining reactor 2 with attached recirculating cyclone 3. Fluidizing gas containing free oxygen is blown in through line 4, and the gas may be air, air enriched with $O_2$, or another gas rich in $O_2$. In the reactor 2, base metal sulfides are converted to base metal oxides, and a $SO_2$-containing exhaust gas is produced. Solids and exhaust gas are supplied through the conduit 5 to the recirculating cyclone 3, in which the solids are largely deposited and in part recirculated through lines 7 and 8 to the reactor 2. Part of the hot solids are supplied through line 9 to a fluidized-bed cooler 10 comprising cooling elements 11 for indirect cooling. Fluidizing gas, e.g. air or cooled, $SO_2$-containing exhaust gas, is supplied through line 12 and leaves the cooler 10 in the heated condition through line 13, which likewise opens into the reactor 2. A cooled solids mixture is withdrawn from the cooler 10 through line 15, and can in part be recirculated through line 16, in a manner not represented in detail, to the reactor 2.

A cooled, metal-oxide-containing solids mixture coming from the cooler 10 is supplied through line 19 to a fluidized-bed reactor 20. The $SO_2$-containing exhaust gas from the cyclone 3 is supplied to this fluidized-bed reactor 20 through line 21, and from a central tube 22 into the fluidized bed in the reactor 20. Exhaust gas, which contains $SO_2$, leaves the reactor 20 through line 23, is dedusted in an electrostatic precipitator 24 and withdrawn through line 25. A partial stream is supplied to the reactor 20 as fluidizing gas through line 26 by means of the blower 27, the lines 28 and 31 and the distributor 32. Air, air enriched with $O_2$ or technically pure oxygen is added through line 35. In the reactor 20, the fluidizing gas first of all flows into the gas distribution space 33, before it flows upwards through the grid 34 to the fluidized bed not represented here.

The fluidized-bed reactor 20 has a guiding surface 36, which has the shape of an inverted funnel and effects a circulation of the solids along the arrows 37. For dissipating heat through an indirect heat exchange, cooling elements 40 are provided.

In the fluidized-bed reactor 20, base metal oxides supplied through line 19 are at least partially converted into base metal sulfates. If it is desired to accelerate the desired sulfate-forming reactions, it is recommended to enrich the exhaust gas supplied through line 43 with $SO_3$, which is effected through catalytic conversion of $SO_2$ in the presence of $O_2$. For this purpose, the exhaust gas of line 43 is passed over a catalyst 44 (e.g. a platinum catalyst with a honeycomb structure) and then through an indirect cooler 45, before the gas is introduced into the reactor 20. The catalyst 44 reacts $SO_2$ with $O_2$ to form $SO_3$, and catalysts for instance on the basis of vanadium pentoxide are commercially available. Since the reaction on the catalyst 44 is an exothermal reaction, the subsequent connection of a cooler 45 is recommended.

The exhaust gas, which comes from the electrotatic precipitator 24 via line 25 and is not recirculated to the reactor 20, is passed through a further dedusting and cooling unit 48, where for instance a wet purification may be combined with a dry dedusting (e.g. electrostatic precipitator or bag filter). Purified gas is withdrawn via line 49. A partial stream of this gas is delivered through the blower 50 to a heater 51. Through line 52, air, air enriched with $O_2$ or technically pure oxygen is added to the heated gas in line 43, before the gas flows into the catalyst 44. A partial stream of the $SO_2$-containing exhaust gas of line 49 can furthermore be supplied to the fluidized-bed cooler 10 through line **12*a*** indicated in phantom lines.

A solids mixture containing base metal sulfate leaves the reactor 20 through line 53 and is charged into a stirred tank 54. Dilute sulfuric acid is supplied to this tank 54 through line 55, so that as much as possible of the base metal sulfates are dissolved. Iron sulfate is very soluble in the acid solution, and the sulfates of copper, nickel and zinc likewise have a good solubility. Solids and solution are supplied through line 56 to a settling tank 57, from which the liquid phase low in solids is withdrawn through line 58. The phase rich in solids, which contains gold and/or silver, is supplied through line 59 first to a washing treatment 60, before it is supplied through line 61 to the recovery of gold and/or silver not represented here, in particular a recovery through cyaniding.

The liquid in line 58 contains dissolved base metal sulfates, as well as some silver sulfate where part of the base metals and the silver can be recovered. In a manner known per se, copper and silver can be bound to scrap iron 62, which is disposed in the tank 63 in the form of a filter layer and is exchanged periodically. There is subsequently provided a zinc extraction 65, which is for instance performed in a manner known per se, as it is described in EP-A-0538168. The remaining solution containing iron sulfate is charged into a stirred tank 68, to which limestone powder is added through line 69. There is thus obtained a gypsum sludge, which is withdrawn via line 70 and can be dumped after a dehydration not represented here.

EXAMPLE

In a pilot plant corresponding to the drawing, the calcining reactor 2 has a height of 4 m and an inside diameter of 0.2 m. To this reactor, a crude ore having a specific weight of 2.52 kg/l is added through line 1, which crude ore contains fine grain below 5 μm in an amount of 15 wt-% and coarse grain above 1 mm in an amount of 0.1 wt-%. The main constituents of the ore are as follows:

| | |
|---|---|
| Fe | 7.8 wt-% |
| S | 9.0 wt-% |
| Zn | 0.3 wt-% |
| Cu | 0.2 wt-% |
| C (organic) | 0.5 wt-% |
| inert substances and quartz | 82.2 wt-% |

The ore contains 8.5 ppm gold and 25 ppm silver.

Further process conditions are:

Amount of crude ore through line 1: 20 kg/h, temperature in the calcining reactor 2: 680° C.

The total amount of the air-$O_2$ mixture delivered to the calcining reactor through lines 4 and 13 is 30 $Nm^3/h$. The air-$O_2$ mixture contains 36 vol-% $O_2$.

The calcined ore of line 19 is supplied to the fluidized-bed reactor 20 in an amount of 19.0 kg/h and at a temperature of 200° C., and it has the following composition:

| | |
|---|---|
| $Fe_2O_3$ | 11.8 wt-% |
| S | 0.5 wt-% |
| ZnO | 0.4 wt-% |
| CuO | 0.3 wt-% |
| C (organic) | 0.1 wt-% |
| inert substances and quartz | 86.9 wt-% |

In addition, the ore has the above-mentioned gold and silver content. The following gases are supplied to the fluidized-bed reactor 20 through line 21 and the distributor 32:

| | Line 21 | Distributor 32 |
|---|---|---|
| Amount ($Nm^3/h$) | 29 | 3 |
| $SO_2$ content (vol-%) | 3.7 | 1.2 |
| $SO_3$ content (vol-%) | 0.2 | 0.01 |
| $O_2$ content (vol-%) | 30 | 30 |
| Temperature | 680° C. | 450° C. |

The solids in line 53 are withdrawn in an amount of 20.5 kg/h at a temperature of 450° C., and their composition is as follows:

| | |
|---|---|
| $Fe_2O_3$ | 5.9 wt-% |
| $Fe_2(SO_4)_3$ | 12.3 wt-% |
| $ZnSO_4$ | 0.7 wt-% |
| $CuSO_4$ | 0.5 wt-% |
| C (organic) | 0.1 wt-% |
| inert substances and quartz | 80.5 wt-% |

In addition to the solids of line 53, 200 l/h dilute sulfuric acid including 1.5 wt-% $H_2SO_4$ are added to the stirred tank 54. The liquid in line 58 contains 4.5 kg/h $Fe_2(SO_4)_3$, 0.14 kg/h $ZnSO_4$ and 0.09 kg/h $CUSO_4$. The solids suspension, which flows through line 59, contains 17 kg/h solids, namely:

| | |
|---|---|
| $Fe_2O_3$ | 2.5 wt-% |
| S | 0.6 wt-% |
| inert substances and quartz | 96.9 wt-% |

The content of Cu and Zn is below 0.01 wt-%. The solids mixture is very well suited for cyaniding for the recovery of gold.

What is claimed is:

1. A process for treating a granular sulfide ore containing a noble metal selected from the group consisting of silver and gold and iron as at least one base metal, which comprises the steps of:

(a) calcining the granular sulfide ore at a temperature of 600° to 900° C. with addition of gas containing free oxygen to produce a noble metal-containing, base metal oxide-containing solids mixture and an $SO_2$-containing exhaust gas;

(b) cooling the noble metal-containing, base metal oxide-containing solids mixture to a temperature at least 50° C. lower than that of the calcining of step (a) to form a cooled solids mixture;

(c) charging the cooled solids mixture into a fluidized bed reactor and introducing $SO_2$-containing exhaust gas formed during step (a) into the fluidized bed reactor to produce in the cooled solids mixture a base metal sulfate where at least 10% by weight of the sulfur content in the exhaust gas is bound in the form of the base metal sulfate;

(d) withdrawing the cooled solids mixture containing the noble metal and the base metal sulfate from the fluidized bed reactor;

(e) stirring the cooled solids mixture in an aqueous acid solution to dissolve base metal sulfate into said aqueous acid solution and separating remaining solids containing the noble metal from the aqueous acid solution; and (f) supplying the remaining solids to a recovery of the noble metal.

2. The process defined in claim 1 wherein in step (c) in the fluidized bed reactor, the base metal sulfate is produced at a temperature of 250° to 650° C.

3. The process defined in claim 1 wherein at least part of the $SO_2$ in the $SO_2$-containing exhaust gas produced in step (a) is catalytically oxidized to form $SO_3$ outside the fluidized bed reactor, before the $SO_2$-containing exhaust gas is introduced into the fluidized bed reactor according to step (c).

4. The process defined in claim 1 wherein the noble metal-containing, base metal oxide-containing solids mixture produced through calcination of the sulfide ore according to step (a) is cooled to temperatures in the range of 100° to 650° C., before being charged into the fluidized bed reactor according to step (c).

5. The process defined in claim 1 wherein in step (a) the sulfide ore is calcined in a circulating fluidized bed.

6. The process defined in claim 1 wherein in step (b) cooling the noble metal-containing, base metal oxide-containing solids mixture is facilitated by bringing cooled $SO_2$-containing exhaust gas into direct contact with said solids mixture.

7. The process defined in claim 1 wherein in step (e) silver sulfate is dissolved in the aqueous acid solution together with the base metal sulfate and said silver sulfate is recovered by deposition onto a filter layer of scrap iron.

* * * * *